US007959981B2

(12) United States Patent
Sadvary et al.

(10) Patent No.: US 7,959,981 B2
(45) Date of Patent: Jun. 14, 2011

(54) PROCESS FOR DEPOSITING MULTIPLE COATINGS LAYERS ON A SUBSTRATE

(75) Inventors: Richard J. Sadvary, Pittsburgh, PA (US); Dennis A. Simpson, Sarver, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 960 days.

(21) Appl. No.: 11/845,324

(22) Filed: Aug. 27, 2007

(65) Prior Publication Data

US 2009/0061097 A1 Mar. 5, 2009

(51) Int. Cl.
*B05D 7/16* (2006.01)

(52) U.S. Cl. ..... 427/407.1; 427/409

(58) Field of Classification Search ..... 427/385.5, 427/372.2

See application file for complete search history.

(56) References Cited

U.S. PATENT DOCUMENTS

| | | | | |
|---|---|---|---|---|
| 4,546,046 | A * | 10/1985 | Etzell et al. | 428/460 |
| 4,615,940 | A | 10/1986 | Panush et al. | |
| 4,620,993 | A * | 11/1986 | Suss et al. | 427/407.1 |
| 4,620,994 | A * | 11/1986 | Suss et al. | 427/407.1 |
| 6,034,166 | A | 3/2000 | Jackson et al. | |
| 2004/0028822 | A1 | 2/2004 | Dutt et al. | 427/385.5 |
| 2005/0176880 | A1 | 8/2005 | Fujii et al. | |
| 2006/0121205 | A1 | 6/2006 | Menovcik et al. | |
| 2007/0028806 | A1 | 2/2007 | Piro et al. | |

FOREIGN PATENT DOCUMENTS

| | | |
|---|---|---|
| EP | 0 388 932 | 9/1990 |
| EP | 1 764 161 | 3/2007 |

* cited by examiner

*Primary Examiner* — Erma Cameron

(74) *Attorney, Agent, or Firm* — Steven W. Hays

(57) ABSTRACT

A process for coating a substrate comprising (a) applying a solventborne primer coating composition onto at least a portion of the substrate; (b) applying a solventborne color containing coating composition onto at least a portion of the solventborne primer coating composition, wherein the solventborne color containing coating composition comprises a colorant and an insoluble microparticle; and (c) curing at least a portion of the solventborne primer coating composition and the solventborne color containing coating composition.

19 Claims, No Drawings

PROCESS FOR DEPOSITING MULTIPLE COATINGS LAYERS ON A SUBSTRATE

BACKGROUND OF THE INVENTION

1. Field of the Invention

The present invention relates to a method of coating a substrate.

2. Background Information

A conventional automotive coating process typically includes the sequential application of coating compositions onto a substrate. For example, an electrodepositable coating composition, usually a cationic composition, is applied onto a pretreated substrate. The electrodepositable coating composition is then cured prior to application of a primer-surfacer coating composition over the electrodeposition coating. The primer-surface layer typically masks any surface defects present in the electrodeposition coating, thereby ensuring a smooth appearance of the subsequently applied top coatings to the coating layer system.

After the primer-surfacer coating composition has been applied onto the cured electrodepositable coating, the primer-surfacer coating is cured and sanded to remove surface defects. A color-enhancing and/or effect-enhancing basecoating composition is then applied onto the primer-surfacer coating. The basecoating is typically given a flash bake at a temperature and for a time sufficient to drive off excess solvents, but insufficient to cure the basecoating composition. A transparent or clear coating composition is then applied onto the uncured basecoating. This is commonly referred to as a wet-on-wet application. The basecoating composition and the transparent or clear coating composition are then cured together in a single step.

There is, however, a need for a coating process that reduces and/or eliminates that number of steps and/or coating compositions used during the coating process thereby reducing the time and cost issues typically associated with coating a substrate.

SUMMARY OF THE INVENTION

The present invention is directed to a process for coating a substrate that comprises (a) applying a solventborne primer coating composition onto at least a portion of the substrate; (b) applying a solventborne color containing coating composition onto at least a portion of the solventborne primer coating composition, wherein the solventborne color containing coating composition comprises a colorant and an insoluble microparticle; and (c) curing at least a portion of the solventborne primer coating composition and the solventborne color containing coating composition.

DETAILED DESCRIPTION OF THE INVENTION

As used herein, unless otherwise expressly specified, all numbers such as those expressing values, ranges, amounts or percentages may be read as if prefaced by the word "about", even if the term does not expressly appear. Plural encompasses singular and vice versa. For example, although reference is made herein (including the claims) to "a" primer coating composition, "a" color containing coating composition, "a" substantially non-pigmented coating composition, a mixture of any of these can be used.

As employed herein, the term "number" means one or an integer greater than one (ie., a plurality).

When referring to any numerical range of values, such ranges are understood to include each and every number and/or fraction between the stated range minimum and maximum.

As used herein, the term "polyol" or variations thereof refers broadly to a material having an average of two or more hydroxyl groups per molecule. It will be understood, however, that a "polyol" residue or moiety in a reaction product encompasses a material that may have one or more hydroxyl groups per molecule.

The present invention is directed to a process for coating a substrate that reduces and/or eliminates that number of steps and/or coating compositions used during the coating process by eliminating the application of a primer-surfacer coating composition from the coating process. Accordingly, one advantage that is derived from the present invention is the elimination of post-application surface modification steps, such as sanding, of the primer-surfacer coating.

As stated above, the process begins with the application of a solventborne primer coating composition onto a substrate. The solventborne primer coating composition is typically applied onto at least a portion of the substrate using techniques that are known in the art. For example, the solventborne primer composition may be applied using techniques known in the art such as, without limitation, spraying, electrostatic spraying, high rotational electrostatic bells, and the like.

The type of substrate onto which the solventborne primer coating composition is applied is not meant to be limiting and, therefore, includes metal substrates, metal alloy substrates, and/or substrates that have been metallized, such as nickel plated plastic. In certain embodiments, the metal or metal alloy can be aluminum and/or steel. For example, the steel substrate could be cold rolled steel, electrogalvanized steel, and hot dipped galvanized steel. Moreover, in some embodiments, the substrate may comprise a portion of a vehicle such as a vehicular body (e.g., without limitation, door, body panel, trunk deck lid, roof panel, hood, and/or roof) and/or a vehicular frame. As used herein, "vehicle" or variations thereof includes, but is not limited to, civilian, commercial, and military land vehicles such as cars and trucks. It will also be understood that, in some embodiments, the substrate may be pretreated with a pretreatment solution, such as a zinc phosphate solution as described in U.S. Pat. Nos. 4,793,867 and 5,588,989, which are incorporated herein by reference, or not pretreated with a pretreatment solution.

In certain embodiments, the solventborne primer coating composition is applied onto a substrate that has been at least partially coated with an electrodepositable coating composition such as those described in U.S. patent application Ser. No. 11/835,600, which is incorporated herein by reference. For clarity, when referring to a "substrate" herein, it should be noted that the substrate may or may not be pretreated and/or may or may not have an electrodepositable coating.

In some embodiments, the solventborne primer coating composition comprises an acrylic polymer, a polyester polymer, a polyurethane polymer, a polyether polymer, a polyepoxide polymer, a silicon-containing polymer, or combinations thereof. Moreover, the polymer in the solventborne primer coating composition have a number of reactive functional groups that can react with a crosslinking agent that is typically incorporated within the solventborne primer coating composition. For example, the reactive functional groups include, without limitation, a hydroxyl group, a carboxyl group, an isocyanate group, a blocked isocyanate group, a primary amine group, a secondary amine group, an amide group, a carbamate group, a urea group, a urethane group, a vinyl group, an unsaturated ester group, a maleimide group, a fumarate group, an anhydride group, a hydroxy alkylamide group, an epoxy group, or combinations thereof.

Suitable hydroxyl group and/or carboxyl group-containing acrylic polymers can be prepared from polymerizable ethylenically unsaturated monomers and are typically copolymers of (meth)acrylic acid and/or hydroxylalkyl esters of (meth) acrylic acid with one or more other polymerizable ethylenically unsaturated monomers such as alkyl esters of (meth) acrylic acid including methyl (meth)acrylate, ethyl (meth) acrylate, butyl (meth)acrylate and 2-ethyl hexylacrylate, and vinyl aromatic compounds such as styrene, alpha-methyl styrene, and vinyl toluene. As used herein, "(meth)acrylate" and like terms is intended to include both acrylates and methacrylates.

In some embodiments of the present invention, the acrylic polymer can be prepared from ethylenically unsaturated, beta-hydroxy ester functional monomers. Such monomers can be derived from the reaction of an ethylenically unsaturated acid functional monomer, such as monocarboxylic acids, for example, acrylic acid, and an epoxy compound which does not participate in the free radical initiated polymerization with the unsaturated acid monomer. Examples of such epoxy compounds include glycidyl ethers and esters. Suitable glycidyl ethers include glycidyl ethers of alcohols and phenols such as butyl glycidyl ether, octyl glycidyl ether, phenyl glycidyl ether and the like. Suitable glycidyl esters include those which are commercially available from Shell Chemical Company under the tradename CARDURA E; and from Exxon Chemical Company under the tradename GLYDEXX-10. Alternatively, the beta-hydroxy ester functional monomers can be prepared from an ethylenically unsaturated, epoxy functional monomer, for example glycidyl (meth)acrylate and allyl glycidyl ether, and a saturated carboxylic acid, such as a saturated monocarboxylic acid, for example isostearic acid.

Epoxy functional groups can be incorporated into the polymer prepared from polymerizable ethylenically unsaturated monomers by copolymerizing oxirane group-containing monomers, for example glycidyl (meth)acrylate and allyl glycidyl ether, with other polymerizable ethylenically unsaturated monomers, such as those discussed above. Preparation of such epoxy functional acrylic polymers is described in detail in U.S. Pat. No. 4,001,156 at columns 3 to 6, incorporated herein by reference.

Carbamate functional groups can be incorporated into the polymer prepared from polymerizable ethylenically unsaturated monomers by copolymerizing, for example, the above-described ethylenically unsaturated monomers with a carbamate functional vinyl monomer such as a carbamate functional alkyl ester of methacrylic acid. Useful carbamate functional alkyl esters can be prepared by reacting, for example, a hydroxyalkyl carbamate, such as the reaction product of ammonia and ethylene carbonate or propylene carbonate, with methacrylic anhydride. Other useful carbamate functional vinyl monomers include, for instance, the reaction product of hydroxyethyl methacrylate, isophorone diisocyanate, and hydroxypropyl carbamate; or the reaction product of hydroxypropyl methacrylate, isophorone diisocyanate, and methanol. Still other carbamate functional vinyl monomers may be used, such as the reaction product of isocyanic acid (HNCO) with a hydroxyl functional acrylic or methacrylic monomer such as hydroxyethyl acrylate, and those described in U.S. Pat. No. 3,479,328, incorporated herein by reference. Carbamate functional groups can also be incorporated into the acrylic polymer by reacting a hydroxyl functional acrylic polymer with a low molecular weight alkyl carbamate such as methyl carbamate. Pendant carbamate groups can also be incorporated into the acrylic polymer by a "transcarbamoylation" reaction in which a hydroxyl functional acrylic polymer is reacted with a low molecular weight carbamate derived from an alcohol or a glycol ether. The carbamate groups exchange with the hydroxyl groups yielding the carbamate functional acrylic polymer and the original alcohol or glycol ether. Also, hydroxyl functional acrylic polymers can be reacted with isocyanic acid to provide pendent carbamate groups. Likewise, hydroxyl functional acrylic polymers can be reacted with urea to provide pendent carbamate groups.

The polymers prepared from polymerizable ethylenically unsaturated monomers can be prepared by solution polymerization techniques, which are well-known to those skilled in the art, in the presence of suitable catalysts such as organic peroxides or azo compounds, for example, benzoyl peroxide or N,N-azobis(isobutylronitrile). The polymerization can be carried out in an organic solution in which the monomers are soluble by techniques conventional in the art. Alternatively, these polymers can be prepared by aqueous emulsion or dispersion polymerization techniques which are well-known in the art. The ratio of reactants and reaction conditions are selected to result in an acrylic polymer with the desired pendent functionality.

In some embodiments, a polyester polymer can be prepared via a condensation reaction of an acid, such as a diacid, and a polyol using techniques that are known in the art. Suitable acids which can be used to prepare the polyester polymer include, but are not limited to, isophthalic acid, terephthalic acid, e-caprolactone, 1,4-Cyclohexanediacid, PRIPOL, dimerized fatty acids, maleic anhydride, hexahydrophthalic anhydride, methylhexahydrophthalic anhydride, tetrahydrophthalic anhydride, phthalic anhydride, adipic acid, azelaic acid, or combinations thereof. Suitable polyols which can be used to prepare the polyester polymer include, but are not limited to, 1,6-hexanediol, butylethylpropanediol, 1,4-cyclohexanedimethanol, 2-methyl-1,3-propanediol, polytetramethylene ether glycols and its oligomers, polytetrahydrofuran and its oligomers, dipropylene glycol, neopentyl glycol, neopentyl glycol hydroxy pivalate, trimethylol propane, butane diol, tripropylene glycol, or combinations thereof.

In certain embodiments, hydroxyl group-containing polyesters can be prepared by reacting an anhydride of a dicarboxylic acid such as hexahydrophthalic anhydride with a diol such as neopentyl glycol in a 1:2 molar ratio. Where it is desired to enhance air-drying, suitable drying oil fatty acids may be used and include those derived from linseed oil, soya bean oil, tall oil, dehydrated castor oil, or tung oil.

In certain embodiments, the solventborne primer coating composition comprises a polyester polymer which is a reaction product of neopentyl glycol, neopentyl glycol hydroxy pivalate, trimethylol propane, adipic acid, e-caprolactone, and isophthalic acid Carbamate functional polyesters can be prepared by first forming a hydroxyalkyl carbamate that can be reacted with the polyacids and polyols used in forming the polyester. Alternatively, terminal carbamate functional groups can be incorporated into the polyester by reacting isocyanic acid with a hydroxy functional polyester. Also, carbamate functionality can be incorporated into the polyester by reacting a hydroxyl polyester with a urea. Additionally, carbamate groups can be incorporated into the polyester by a transcarbamoylation reaction. Preparation of suitable carbamate functional group-containing polyesters are those described in U.S. Pat. No. 5,593,733 from column 2, line 40 to column 4, line 9, which is incorporated herein by reference.

In some embodiments, the polymer can comprise ≧5% of the total resin solids of the solventborne primer coating composition. In other embodiments, the polymer can comprise ≦80% of the total resin solids of the solventborne primer coating composition. In certain embodiments, the total amount of the polymer can range between any combination of values, which were recited in the preceding sentences, inclusive of the recited values. For example, in some embodiments the polymer can comprise 30% -50% of the total resin solids of the solventborne primer coating composition.

As stated above, the polymer in the solventborne primer coating composition comprises a number of functional groups that can react with a crosslinking agent that is incorporated within the solventborne primer coating composition. Dependent upon the reactive functional groups of the polymer in the solventborne primer coating composition, the curing agent can be selected from an aminoplast resin, an isocyanate, a polyepoxide, a polyacid, an anhydride, an amine, a polyol, or combinations thereof.

An aminoplast can be utilized as curing agents for hydroxyl, carboxylic acid, and carbamate functional group-containing materials are well known in the art. Suitable aminoplast resins, such as, for example, those discussed above, are known to those of ordinary skill in the art. Aminoplasts can be obtained from the condensation reaction of formaldehyde with an amine or amide. Nonlimiting examples of amines or amides include melamine, urea, or benzoguanamine. Condensates with other amines or amides can be used; for example, aldehyde condensates of glycoluril, which give a high melting crystalline product useful in powder coatings. While the aldehyde used is most often formaldehyde, other aldehydes such as acetaldehyde, crotonaldehyde, and benzaldehyde can be used.

The aminoplast typically contains imino and methylol groups and in certain instances at least a portion of the methylol groups are etherified with an alcohol to modify the cure response. Any monohydric alcohol can be employed for this purpose including methanol, ethanol, n-butyl alcohol, isobutanol, and hexanol.

Nonlimiting examples of aminoplasts include melamine-, urea-, or benzoguanamine-formaldehyde condensates, in certain instances monomeric and at least partially etherified with one or more alcohols containing from one to four carbon atoms. Nonlimiting examples of suitable aminoplast resins are commercially available, for example, from Cytec Industries, Inc. under the trademark CYMEL, from INEOS Melamines under the trademark RESIMENE, and from BASF under the trademark LUWIPAL.

As will be discussed in greater detail below, in some embodiments, the solventborne primer coating composition comprises a melamine curing agent wherein the melamine curing agent has a high imino. As used herein, a "high imino" means that the NH functionality of a particular compound ranges from 10% -50%.

As stated above, the curing agent can also comprise an isocyanate. As used herein, "isocyanates" also includes polyisocyanates and vice versa. The polyisocyanate curing agent may be a fully blocked polyisocyanate with substantially no free isocyanate groups, or it may be partially blocked and reacted with the resin backbone as described in U.S. Pat. No. 3,984,299. The polyisocyanate can be an aliphatic, an aromatic polyisocyanate, or combinations thereof. In some embodiments, diisocyanates are utilized, although in other embodiments higher polyisocyanates can be used in place of or in combination with diisocyanates.

Any suitable alcohol or polyol can be used as a blocking agent for the polyisocyanate in the electrodepositable coating composition of the present invention provided that the agent will deblock at the curing temperature and provided a gelled product is not formed. For example, suitable alcohols include, without limitation, methanol, ethanol, propanol, isopropyl alcohol, butanol, 2-ethylhexanol, butoxyethanol, hexyloxyethanol, 2-ethylhexyloxyethanol, n-butanol, cyclohexanol phenyl carbinol, methylphenyl carbinol, ethylene glycol monobutyl ether, diethylene glycol monobutylether, ethylene glycol monomethylether, propylene glycol monomethylether, or combinations thereof.

In certain embodiments of the present invention, the blocking agent comprises one or more 1,3-glycols and/or 1,2-glycols. In one embodiment of the present invention, the blocking agent comprises one or more 1,2-glycols, typically one or more $C_3$ to $C_6$ 1,2-glycols. For example, the blocking agent can be selected from at least one of 1,2-propanediol, 1,3-butanediol, 1,2-butanediol, 1,2-pentanediol, timethylpentene diol, and/or 1,2-hexanediol.

As stated above, the curing agent can comprise an anhydride, which is typically used as curing agents for hydroxy functional group containing materials. Nonlimiting examples of anhydrides suitable for use as curing agents in the compositions of the invention include those having at least two carboxylic acid anhydride groups per molecule which are derived from a mixture of monomers comprising an ethylenically unsaturated carboxylic acid anhydride and at least one vinyl co-monomer, for example, styrene, alpha-methyl styrene, vinyl toluene, and the like. Nonlimiting examples of suitable ethylenically unsaturated carboxylic acid anhydrides include maleic anhydride, citraconic anhydride, and itaconic anhydride. Alternatively, the anhydride can be an anhydride adduct of a diene polymer such as maleinized polybutadiene or a maleinized copolymer of butadiene, for example, a butadiene/styrene copolymer. These and other suitable anhydride curing agents are described in U.S. Pat. No. 4,798,746 at column 10, lines 16-50; and in U.S. Pat. No. 4,732,790 at column 3, lines 41-57, both of which are incorporated herein by reference.

Polyepoxides can be utilized as curing agents for carboxylic acid functional group-containing materials are well known in the art. Nonlimiting examples of polyepoxides suitable for use in the compositions of the present invention comprise polyglycidyl esters (such as acrylics from glycidyl methacrylate), polyglycidyl ethers of polyhydric phenols and of aliphatic alcohols, which can be prepared by etherification of the polyhydric phenol, or aliphatic alcohol with an epihalohydrin such as epichlorohydrin in the presence of alkali. These and other suitable polyepoxides are described in U.S. Pat. No. 4,681,811 at column 5, lines 33 to 58, which is incorporated herein by reference.

Suitable curing agents for epoxy functional group-containing materials comprise polyacid curing agents, such as the acid group-containing acrylic polymers prepared from an ethylenically unsaturated monomer containing at least one carboxylic acid group and at least one ethylenically unsaturated monomer which is free from carboxylic acid groups. Such acid functional acrylic polymers can have an acid number ranging from 30 to 150. Acid functional group-containing polyesters can be used as well. The above-described polyacid curing agents are described in further detail in U.S. Pat. No. 4,681,811 at column 6, line 45 to column 9, line 54, which is incorporated herein by reference.

Also well known in the art as curing agents for isocyanate functional group-containing materials are polyols. Nonlimiting examples of such materials suitable for use in the compositions of the invention include polyalkylene ether polyols, including thio ethers; polyester polyols, including polyhydroxy polyesteramides; and hydroxyl-containing polycaprolactones and hydroxy-containing acrylic copolymers. Also useful are polyether polyols formed from the oxyalkylation of various polyols, for example, glycols such as ethylene glycol, 1,6-hexanediol, Bisphenol A and the like, or higher polyols such as trimethylolpropane, pentaerythritol, and the like. Polyester polyols also can be used. These and other suitable polyol curing agents are described in U.S. Pat. No. 4,046,729 at column 7, line 52 to column 8, line 9; column 8, line 29 to column 9, line 66; and U.S. Pat. No. 3,919,315 at column 2, line 64 to column 3, line 33, both of which are incorporated herein by reference.

Polyamines also can be used as curing agents for isocyanate functional group-containing materials. Nonlimiting examples of suitable polyamine curing agents include primary or secondary diamines or polyamines in which the radicals attached to the nitrogen atoms can be saturated or unsaturated, aliphatic, alicyclic, aromatic, aromatic-substituted-aliphatic, aliphatic-substituted-aromatic, and heterocyclic. Nonlimiting examples of suitable aliphatic and alicyclic diamines include 1,2-ethylene diamine, 1,2-porphylene diamine, 1,8-octane diamine, isophorone diamine, propane-2,2-cyclohexyl amine, and the like. Nonlimiting examples of suitable aromatic diamines include phenylene diamines and the toluene diamines, for example, o-phenylene diamine and p-tolylene diamine. These and other suitable polyamines described in detail in U.S. Pat. No. 4,046,729 at column 6, line 61 to column 7, line 26, which is incorporated herein by reference.

In addition to the polyester polymer and the curing agent described above, the solventborne primer coating composition can further comprise insoluble microparticles such as, without limitation, polymeric microparticles, microgels (crosslinked microparticles), aluminum oxide, silica, or combinations thereof. As used herein, "silica" includes, without limitation, fumed silica, precipitated silica, colloidal silica, or combinations thereof. As used herein, "insoluble microparticle" means that the material remains in particle form even though it is added to an organic solvent. Other ingredients that can be added to the solventborne primer coating composition are known in the art and include, without limitation, cellulose acetate butyrate (CAB), waxes (e.g., amide wax or polyethylene), metal sulfate, calcium sulfate, high molecular weight polyacrylates, polybutadiene or other polyalkenes (e.g., polyisobutylene, polypropylene, or polyethylene), high molecular weight polyesters/urethanes, polyacids (e.g., polyacrylic acid), polystyrene, polyurea materials (e.g., sag control agents), bentonite clays, polytetrafluoroethylene or PTFE modified waxes, polyvinyl pyrrolidone, or combinations thereof. As used herein, a "high molecular weight" means a molecular weight of ≧20,000 Daltons.

In certain embodiments, the solventborne primer coating composition comprises a microgel as described in U.S. Pat. No. 4,147,688 (column 2, line 6, to column 4, line 10), which is incorporated herein by reference.

In some embodiments, the solventborne primer coating composition can also comprise additives such as, without limitation, calcium sulfonate In some embodiments, the microgel can comprise ≧0.5% of the total resin solids of the total resin solids of the solventborne primer coating composition. In other embodiments, the microgel can comprise ≦20% of the total resin solids of the solventborne primer coating composition. In certain embodiments, the total amount of microgel can range between any combination of values, which were recited in the preceding sentences, inclusive of the recited values. For example, the microgel can comprise 1.5% -3% of the total resin solids of the solventborne primer coating composition.

In some embodiments, the solventborne primer coating composition comprises ≧40% solids based on the total weight of the solventborne primer coating composition. In other embodiments, the solventborne primer coating composition comprises ≦70% solids based on the total weight of the solventborne primer coating composition. In certain embodiments, the total amount of solids in the solventborne primer coating composition can range between any combination of values, which were recited in the preceding sentences, inclusive of the recited values. For example, the total amount of solids can range from 45% to 65% based on the total weight of the solventborne primer coating composition.

After the solventborne primer coating composition is deposited onto at least a portion the substrate, the process further comprises depositing a solventborne color containing coating composition onto at least a portion of the substantially uncured solventborne primer coating composition using techniques that are known in the art, such as those described above. It should be noted that in some embodiments, the solventborne color containing coating composition is deposited onto the solventborne primer coating composition after a specified duration of time. In other words, after application of the solventborne primer coating composition onto the substrate, a certain amount of time may pass prior to depositing the solventborne color containing coating composition onto the uncured solventborne primer coating composition. In some embodiments, the duration of time that can pass between the application of the solventborne primer coating composition onto the substrate and the application of the solventborne color containing coating composition can be ≧30 seconds. In other embodiments, the duration of time can be ≦20 minutes. In certain embodiments, the duration of time can range between any combination of values, which were recited in the preceding sentences, inclusive of the recited values. For example, the duration of time can range between 1 minute and 4 minutes.

The polymer that is be incorporated into the solventborne color containing coating composition can be the same polymer or different a different polymer from the polymer that is incorporated into the solventborne primer coating composition. For example, in some embodiments, a polyester polymer can be used in both the solventborne color containing composition as well as the solventborne primer coating composition. In some embodiments, an acrylic polymer can be used in the solventborne primer coating composition while a polyester polymer is used in the solventborne color containing composition.

It should be noted that the solventborne color containing coating composition that is utilized in the present invention is substantially opaque. As used herein, "substantially opaque" means ≦0.5% light transmission in the wavelengths of the visible light spectrum ranging from 400 nm to 500 nm. It will, therefore, be understood that the coating layer which results from the solventborne color containing coating composition will also be substantially opaque.

In certain embodiments, the solventborne color containing coating composition comprises a polyester polymer which is a reaction product of neopentyl glycol, trimethylol propane, adipic acid, and isophthalic acid.

Dependent upon the reactive functional groups of the polymer in the solventborne color containing coating composition, the curing agent can be selected from an aminoplast resin, an isocyanate, a polyepoxide, a polyacid, an anhydride, an amine, a polyol, or combinations thereof. It should be noted, however, that the curing agent that is used in the solventborne color containing coating composition can be the same curing agent or a different curing agent from the curing agent that is incorporated into the solventborne primer coating composition.

In addition to the polymer and the curing agent described above, the solventborne color coating composition also comprises one or more insoluble microparticles and/or other ingredients such as those described in the preceding paragraphs. It should be noted that the insoluble microparticles used in the solventborne color coating composition may be the same or different from the insoluble microparticles used in the solventborne primer coating composition.

It has been surprisingly discovered that use of a microgel in the solventborne color containing coating composition in combination with the process that is described herein, which lacks a primer-surfacer coating layer, produces a multilayer composite coating system that is substantially equivalent in appearance to a multilayer composite coating system that includes the primer-surfacer coating layer. In some embodiments, the microgel can comprise ≧0.5% of the total resin solids of the solventborne color containing coating composition. In other embodiments, the microgel can comprise ≦20% of the total resin solids of the solventborne color containing coating composition. In certain embodiments, the total amount of microgel in the solventborne color containing coating composition can range between any combination of values, which were recited in the preceding sentences, inclusive of the recited values. For example, the amount of microgel in the solventborne coating composition can range from 2% -4%, from 10% -15%, or from 2% -15%. It should be noted that the total amount of microgel used in the solventborne coating composition will depend upon the color of the solventborne coating composition.

Moreover, in certain embodiments, cellulose acetate butyrate (CAB), which can be purchased from Eastman Chemicals, is incorporated into the solventborne color containing coating composition. It was surprisingly discovered that a multilayer composite coating system, which comprising a solventborne color containing coating composition, which was produced via the process described herein, and which comprises CAB and a microgel, had an appearance that was equivalent to a multilayer composite coating system that includes the primer-surfacer coating layer.

In some embodiments, the appearance of the multilayer composite coating system that is produced via the process disclosed herein can be enhanced by utilizing in the solventborne primer coating composition a melamine curing agent having a high imino. Moreover, in certain embodiments, the appearance of the multilayer composite coating system can be enhanced by using a solvent, in the solventborne primer coating composition, which has a fast evaporation rate. In other words, the solventborne primer coating composition can comprise a fast solvent. As used herein, "fast evaporation rate" means an evaporation rate that is greater than or equal to that of n-Butyl Acetate, which as a rating of 100. Accordingly, as used herein, a "slow solvent" is a solvent that has an evaporation rate that is lower than that of n-Butyl Acetate.

In some embodiments, CAB can comprise ≧0.5% of the total resin solids of the solventborne color containing coating composition. In other embodiments, CAB can comprise ≦20% of the total resin solids of the solventborne color containing coating composition. In certain embodiments, the total amount of CAB in the solventborne color containing coating composition can range between any combination of values, which were recited in the preceding sentences, inclusive of the recited values. For example, CAB can comprise 5% -15% of the total resin solids of the solventborne color containing coating composition.

In some embodiments, the solventborne color containing coating composition comprises ≧15% solids based on the total weight of the solventborne color containing coating composition. In other embodiments, the solventborne color containing coating composition comprises ≦70% solids based on the total weight of the solventborne color containing coating composition. In certain embodiments, the total amount of solids in the solventborne color containing coating composition can range between any combination of values, which were recited in the preceding sentences, inclusive of the recited values. For example, the total amount of solids can range from 20% to 60% based on the total weight of the solventborne color containing coating composition. It will be understood that the total amount of solids in the solventborne color containing coating composition will be dependent upon the color of the solventborne color containing coating composition.

In some embodiments, after the solventborne color containing coating composition has been applied onto the solventborne primer coating composition, the process further comprises subjecting the coated substrate to conditions sufficient to cure the solventborne primer coating composition as well as the solventborne color containing coating composition. In other words, the solventborne primer coating composition and the solventborne color containing coating composition are cured simultaneously (co-cured). It will be understood that during the curing operation, the solvent in a solventborne coating composition is evaporated from the coating composition, and the film-forming material of the coating composition is cured thereby resulting in a cured coating layer.

Curing of the coating layers can be accomplished by any known curing methods including by thermal energy, infrared, ionizing or actinic radiation, or by any combination thereof. In some embodiments, the curing operation is carried out at temperatures ≧10° C. (50° F.). In other embodiments, the curing operation is carried out at temperature ≦246° C. (475° F.). In certain embodiments, the curing operation is carried out at temperatures ranging between any combination of values, which were recited in the preceding sentences, inclusive of the recited values. For example, the curing operation can be carried out at temperatures ranging from 121.1° C. (250° F.) −148.9° C. (300° F.). It should be noted, however, that lower or higher temperatures may be used as necessary to activate the curing mechanisms.

In certain embodiments, a substantially non-pigmented coating composition is applied onto at least a portion of the uncured solventborne color containing coating composition prior to the coated substrate being subjected to the curing operation. It will be understood that the substantially non-pigmented coating composition may be applied onto the uncured solventborne color containing coating composition using techniques that are known in the art, such as those described above. It should be noted that in some embodiments, the solventborne substantially non-pigmented coating composition is deposited onto the solventborne color containing coating composition after a specified duration of time. In other words, after application of the solventborne color containing coating composition onto the substrate, a certain amount of time may pass prior to depositing the substantially non-pigmented coating composition onto the uncured solventborne color containing coating composition. In some embodiments, the duration of time that can pass between the application of the solventborne color containing coating composition and the application of the substantially non-pigmented coating composition can be ≧30 seconds. In other embodiments, the duration of time can be ≦20 minutes. In certain embodiments, the duration of time can range between any combination of values, which were recited in the preceding sentences, inclusive of the recited values. For example, the duration of time can range between 1 minute and 5 minutes.

After the substantially non-pigmented coating composition is deposited onto at least a portion of the uncured solventborne color containing coating composition, the coated substrate is then subjected to the curing operation in order to cure the solventborne primer coating composition, the solventborne color containing coating composition, and the substantially non-pigmented coating composition. In other words, all three coating compositions are simultaneously cured (co-cured).

Suitable substantially non-pigmented coating compositions can include aqueous coating compositions, solvent-based compositions, and compositions in solid particulate form (ie., powder coating compositions). Any of the transparent or clear coating compositions known in the art are suitable for this purpose. For example, suitable non-limiting examples include the clear coating compositions comprising acrylic/melamines and/or those described in U.S. Pat. Nos. 4,650,718; 5,814,410; 5,891,981; and WO 98/14379. Specific non-limiting examples include TKU-1050AR, ODCT8000, and those available under the tradenames DIAMOND COAT and NCT, all commercially available from PPG Industries, Inc.

As used herein, "substantially non-pigmented coating composition" refers to a coating composition which forms a transparent coating, such as a clearcoat. Such compositions are sufficiently free of pigment or particles such that the optical properties of the resultant coatings are not seriously compromised. As used herein, "transparent" means that the cured coating has a BYK Haze index of less than 50 as measured using a BYK/Haze Gloss instrument.

In other embodiments, the solventborne primer coating composition and/or the solventborne color containing coating composition may contain additional ingredients such as colorants and fillers. Any suitable colorants and fillers may be used. For example, the colorant can be added to the coating in any suitable form, such as discrete particles, dispersions, solutions and/or flakes. A single colorant or a mixture of two or more colorants can be used in the coatings of the present invention. It should be noted that, in general, the colorant can be present in a layer of the multi-layer composite in any amount sufficient to impart the desired property, visual and/or color effect.

Example colorants include pigments, dyes and tints, such as those used in the paint industry and/or listed in the Dry Color Manufacturers Association (DCMA), as well as special effect compositions. A colorant may include, for example, a finely divided solid powder that is insoluble but wettable under the conditions of use. A colorant can be organic or inorganic and can be agglomerated or non-agglomerated. Colorants can be incorporated into the coatings by grinding or simple mixing. Colorants can be incorporated by grinding into the coating by use of a grind vehicle, such as an acrylic grind vehicle, the use of which will be familiar to one skilled in the art.

Example pigments and/or pigment compositions include, but are not limited to, carbazole dioxazine crude pigment, azo, monoazo, disazo, naphthol AS, salt type (lakes), benzimidazolone, condensation, metal complex, isoindolinone, isoindoline and polycyclic phthalocyanine, quinacridone, perylene, perinone, diketopyrrolo pyrrole, thioindigo, anthraquinone, indanthrone, anthrapyrimidine, flavanthrone, pyranthrone, anthanthrone, dioxazine, triarylcarbonium, quinophthalone pigments, diketo pyrrolo pyrrole red ("DPP red BO"), titanium dioxide, carbon black, zinc oxide, antimony oxide, etc. and organic or inorganic UV opacifying pigments such as iron oxide, transparent red or yellow iron oxide, phthalocyanine blue and mixtures thereof. The terms "pigment" and "colored filler" can be used interchangeably.

Example dyes include, but are not limited to, those that are solvent and/or aqueous based such as acid dyes, azoic dyes, basic dyes, direct dyes, disperse dyes, reactive dyes, solvent dyes, sulfur dyes, mordant dyes, for example, bismuth vanadate, anthraquinone, perylene, aluminum, quinacridone, thiazole, thiazine, azo, indigoid, nitro, nitroso, oxazine, phthalocyanine, quinoline, stilbene, and triphenyl methane.

As noted above, the colorant can be in the form of a dispersion including, but not limited to, a nanoparticle dispersion. Nanoparticle dispersions can include one or more highly dispersed nanoparticle colorants and/or colorant particles that produce a desired visible color and/or opacity and/or visual effect. Nanoparticle dispersions can include colorants such as pigments or dyes having a particle size of less than 150 nm, such as less than 70 nm, or less than 30 nm. Nanoparticles can be produced by milling stock organic or inorganic pigments with grinding media having a particle size of less than 0.5 mm. Example nanoparticle dispersions and methods for making them are identified in U.S. Pat. No. 6,875,800 B2, which is incorporated herein by reference. Nanoparticle dispersions can also be produced by crystallization, precipitation, gas phase condensation, and chemical attrition (i.e., partial dissolution). In order to minimize re-agglomeration of nanoparticles within the coating, a dispersion of polymer-coated nanoparticles can be used. As used herein, a "dispersion of polymer-coated nanoparticles" refers to a continuous phase in which is dispersed discreet "composite microparticles" that comprise a nanoparticle and a polymer coating on the nanoparticle. Example dispersions of polymer-coated nanoparticles and methods for making them are identified in U.S. application Ser. No. 10/876,031 filed Jun. 24, 2004, which is incorporated herein by reference, and U.S. Provisional Application No. 60/482,167 filed Jun. 24, 2003, which is also incorporated herein by reference.

In one embodiment, special effect compositions that may be used in one or more layers of the multi-layer coating composite include pigments and/or compositions that produce one or more appearance effects such as reflectance, pearlescence, metallic sheen, phosphorescence, fluorescence, photochromism, photosensitivity, thermochromism, goniochromism and/or color-change. Additional special effect compositions can provide other perceptible properties, such as reflectivity, opacity or texture. In a non-limiting embodiment, special effect compositions can produce a color shift, such that the color of the coating changes when the coating is viewed at different angles. Example color effect compositions are identified in U.S. Pat. No. 6,894,086, incorporated herein by reference. Additional color effect compositions can include transparent coated mica and/or synthetic mica, coated silica, coated alumina, a transparent liquid crystal pigment, a liquid crystal coating, and/or any composition wherein interference results from a refractive index differential within the material and not because of the refractive index differential between the surface of the material and the air.

In another embodiment, a photosensitive composition and/or photochromic composition, which reversibly alters its color when exposed to one or more light sources, can be used in a number of layers in the multi-layer composite. Photochromic and/or photosensitive compositions can be activated by exposure to radiation of a specified wavelength. When the composition becomes excited, the molecular structure is changed and the altered structure exhibits a new color that is different from the original color of the composition. When the exposure to radiation is removed, the photochromic and/or photosensitive composition can return to a state of rest, in which the original color of the composition returns. In one non-limiting embodiment, the photochromic and/or photosensitive composition can be colorless in a non-excited state and exhibit a color in an excited state. Full color-change can appear within milliseconds to several minutes, such as from 20 seconds to 60 seconds. Example photochromic and/or photosensitive compositions include photochromic dyes.

In yet another embodiment, the photosensitive composition and/or photochromic composition can be associated with and/or at least partially bound to, such as by covalent bonding, a polymer and/or polymeric materials of a polymerizable component. In contrast to some coatings in which the photosensitive composition may migrate out of the coating and crystallize into the substrate, the photosensitive composition and/or photochromic composition associated with and/or at least partially bound to a polymer and/or polymerizable component in accordance with a non-limiting embodiment of the present invention, have minimal migration out of the coating. Example photosensitive compositions and/or photochromic compositions and methods for making them are identified in U.S. application Ser. No. 10/892,919 filed Jul. 16, 2004 and incorporated herein by reference.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

EXAMPLES

Example 1

Basecoat with Microgel

| Ingredient | Solid Weight (grams) | Weight (grams) |
|---|---|---|
| Solvesso 100[1] | — | 15.0 |
| Ethyl 3-Ethoxypropionate | — | 70.0 |
| N-Butyl Acetate | — | 54.6 |
| Microgel[2] | 10.7 | 24.3 |
| CAB-381-20 Solution[3] | 3.9 | 42.8 |
| CAB-381-0.5 Solution[4] | 5.7 | 28.5 |
| Dow Corning 56[5] | 0.2 | 0.2 |
| Luwipal 018[6] | 25.0 | 34.3 |
| Resamin HF 480[7] | 5.0 | 5.0 |
| SSP 504 AR[8] | 6.0 | 8.6 |
| Sparkle Silver 6246 AR[9] | 6.0 | 9.7 |

-continued

| Ingredient | Solid Weight (grams) | Weight (grams) |
|---|---|---|
| Polyester Polyol[10] | 45.4 | 72.7 |
| Cerafak 106A[11] | 4.1 | 64.3 |
| TOTAL | 112.0 | 430.0 |

[1]Aromatic 100 type solvent available from Exxon.
[2]Insoluble microparticle as described in Example II of US 4,147,688A.
[3]Cellulose Acetate Butyrate available from Eastman Chemical Company dispersed to a 9% solution with n-butyl acetate and n-butanol at a weight ratio of 77.4/13.6 respectively.
[4]Cellulose Acetate Butyrate available from Eastman Chemical Company dispersed to a 20% solution with n-butyl acetate.
[5]Liquid modified silicone available from Dow Corning Corp.
[6]Melamine-formaldehyde resin solution available from BASF Corp.
[7]Butylurethane-formaldehyde resin available from Cytec Surface Specialties.
[8]Aluminum paste available from Silberline Mfg.
[9]Aluminum paste available from Silberline Mfg.
[10]A polyester resin comprising 39% neopentyl glycol, 10% trimethol propane, 17% adipic acid, and 34% isophthalic acid in Aromatic 100 type solvent at 60% solids at about 13000 Mw.
[11]Wax-solvent mixture available from BYK-CERA B.V.

Example 2

Basecoat without Microgel

| Ingredient | Solid Weight (grams) | Weight (grams) |
|---|---|---|
| Solvesso 100 | — | 15.0 |
| Ethyl 3-Ethoxypropionate | — | 70.0 |
| N-Butyl Acetate | — | 56.8 |
| CAB-381-20 Solution | 3.9 | 42.8 |
| CAB-381-0.5 Solution | 5.7 | 28.5 |
| Dow Corning 56 | 0.2 | 0.2 |
| Luwipal 018 | 25.0 | 34.3 |
| Resamin HF 480 | 5.0 | 5.0 |
| SSP 504 AR | 6.0 | 8.6 |
| Sparkle Silver 6246 AR | 6.0 | 9.7 |
| Polyester Polyol | 56.1 | 89.9 |
| Cerafak 106A | 4.1 | 64.3 |
| TOTAL | 112.0 | 425.1 |

Example 3

Basecoat without CAB

| Ingredient | Solid Weight (grams) | Weight (grams) |
|---|---|---|
| Solvesso 100 | — | 15.0 |
| Ethyl 3-Ethoxypropionate | — | 70.0 |
| N-Butyl Acetate | — | 25.0 |
| Microgel (insoluble microparticle) | 10.7 | 24.3 |
| Dow Corning 56 | 0.2 | 0.2 |
| Luwipal 018 | 25.0 | 34.3 |
| Resamin HF 480 | 5.0 | 5.0 |
| SSP 504 AR | 6.0 | 8.6 |
| Sparkle Silver 6246 AR | 6.0 | 9.7 |
| Polyester Polyol | 54.9 | 88.0 |
| Cerafak 106A | 4.1 | 64.3 |
| TOTAL | 111.9 | 344.4 |

Example 4

Primer with Microgel

| Ingredient | Solid Weight (grams) | Weight (grams) |
|---|---|---|
| Isopropyl Acetate | — | 56.7 |
| Microgel (insoluble microparticle) | 3.5 | 8.0 |
| Resimene R-718[12] | 36.5 | 45.7 |
| Polyester Polyol[13] | 40.8 | 59.1 |
| White Pigment Dispersion[14] | 44.3 | 53.7 |
| Extender Pigment Dispersion[15] | 29.8 | 36.0 |
| Black Pigment Dispersion[16] | 4.2 | 9.7 |
| Flow Additive[17] | 0.1 | 0.2 |
| TOTAL | 159.2 | 269.1 |

[12]Melamine-formaldehyde resin solution available from INEOS Melamines.

[13]A polyester resin comprising 18% neopentyl glycol, 16% neopentyl glycol hydroxyl pivalate, 8% trimethol propane, 8% adipic acid, 16% e-caprolactone, and 34% isophthalic acid in n-butyl acetate solvent at 69% solids at about 4800 Mw.

[14]Proprietary titanium dioxide pigment dispersion in polyester polyol resin, PPG Industries, Inc.

[15]Proprietary barytes dispersion in polyester polyol resin, PPG Industries, Inc.

[16]Proprietary carbon black dispersion in polyester polyol resin, PPG Industries, Inc.

[17]Poly butyl acrylate flow additive available from Dupont.

Example 5

Primer without Microgel

| Ingredient | Solid Weight (grams) | Weight (grams) |
|---|---|---|
| Isopropyl Acetate | — | 53.2 |
| Resimene R-718 | 36.5 | 45.7 |
| Polyester Polyol | 44.3 | 64.2 |
| White Pigment Dispersion | 44.3 | 53.7 |
| Extender Pigment Dispersion | 29.8 | 36.0 |
| Black Pigment Dispersion | 4.2 | 9.7 |
| Flow Additive | 0.1 | 0.2 |
| TOTAL | 159.2 | 262.7 |

Example 6

Primer with "Slow" Solvent

| Ingredient | Solid Weight (grams) | Weight (grams) |
|---|---|---|
| Ethyl 3-Ethoxypropionate | — | 82.5 |
| Microgel (insoluble microparticle) | 3.5 | 8.0 |
| Resimene R-718 | 36.5 | 45.7 |
| Polyester Polyol | 40.8 | 59.1 |
| White Pigment Dispersion | 44.3 | 53.7 |
| Extender Pigment Dispersion | 29.8 | 36.0 |
| Black Pigment Dispersion | 4.2 | 9.7 |
| Flow Additive | 0.1 | 0.2 |
| TOTAL | 159.2 | 294.9 |

The film forming compositions (Examples 1-6) were spray applied to over electrocoated steel panels. The panels use were ACT cold roll steel panels (10 cm by 30 cm) with ED6060 electrocoat available from ACT Laboratories, Inc. The primer, basecoat, and clearcoat were automated spray applied to the electrocoated steel panels at ambient temperature (about 72° F. (22° C.)). The primer was applied in one coat to a target dry film thickness of about 1.0 mils (about 25 micrometers). The primer layer was given a three minute ambient air flash prior to the application of the basecoat. The basecoat was applied in one coat over the primer layer to a target dry film thickness of about 0.6 mils (about 15 micrometers). The primer/basecoat layer was given a four minute ambient air flash prior to the application of the clearcoat. The clearcoat was applied in two coats with a ninety second ambient air flash between coats over the primer—basecoat layer. A dry film thickness of about 1.5 mils (about 38 micrometers) was targeted for the clearcoat. The clearcoat used was an acrylic-melamine clear sold by PPG Industries, Inc under the trademark HIGH TECH Clear.

The primer/basecoat/clearcoat layer was given a five minute ambient air flash before an oven bake. Panels were baked for thirty minutes at 285° F. (140° C.) to fully cure the coating system.

The panels were tested for appearance properties as measured by DOI (Distinctness of Image) using a DOI/Haze meter Model 807A available from TRICOR Systems Inc. and by Flip/Flop using a Multi-Angle Spectrophotometer MA 6811 available from X-Rite, Inc.

Appearance Properties

| Example # | | | | |
|---|---|---|---|---|
| Primer | Basecoat | Clearcoat | DOI | Flip/Flop |
| 4 | 1 | yes | 91 | 10.2 |
| 4 | 2 | yes | 53 | 4.8 |
| 4 | 1 | yes | 91 | 10.2 |
| 4 | 4 | yes | 90 | 6.6 |
| 4 | 1 | yes | 91 | 10.2 |
| 5 | 1 | yes | 87 | 9.8 |
| 4 | 1 | yes | 91 | 10.2 |
| 6 | 1 | yes | 78 | 8.3 |
| 4 | 1 | no | 11 | 10.8 |
| 4 | 2 | no | 6 | 9.6 |

What is claimed is:

1. A method of coating a substrate comprising:

(a) applying a solventborne primer coating composition onto at least a portion of said substrate;

(b) applying a solventborne color containing coating composition onto at least a portion of said solventborne primer coating composition, wherein said solventborne color containing coating composition comprises a colorant and an insoluble microparticle and cellulose acetate butyrate; and (c) curing at least a portion of said solventborne primer coating composition and said solventborne color containing coating composition.

2. The method according to claim 1, further comprising applying a substantially non-pigmented coating composition onto at least a portion of said solventborne color containing coating composition prior to step (c), and wherein step (c) further comprises curing said substantially non-pigmented coating composition.

3. The method according to claim 1, further comprising applying an electrodepositable coating composition onto at least a portion of said substrate prior to step (a).

4. The method according to claim 1, wherein said insoluble microparticle comprises 0.5% to 20% by weight based on the total resin solids of said solventborne color containing coating composition.

5. The method according to claim 1, wherein said insoluble microparticle comprises a fumed silica, a precipitated silica, a colloidal silica, a crosslinked microparticle, an aluminum oxide, or combinations thereof.

6. The method according to claim 5, wherein said crosslinked microparticle comprises a crosslinked polymeric microparticle.

7. The method according to claim 1, wherein said solventborne primer coating composition further comprises another insoluble microparticle, and wherein said another insoluble microparticle may be the same or different from said insoluble microparticle.

8. The method according to claim 7, wherein said another insoluble microparticle comprises 0.5% to 20% by weight based on the total resin solids of said solventborne primer coating composition.

9. The method according to claim 7, wherein said another insoluble microparticle comprises a fumed silica, a precipitated silica, a colloidal silica, a crosslinked microparticle, an aluminum oxide, or combinations thereof.

10. The method according to claim 1, wherein said solventborne color containing coating composition further comprises a polyester having reactive functional groups and a curing agent reactive with said reactive functional groups of said polyester.

11. The method according to claim 10, wherein said polyester is a reaction product of neopentyl glycol, trimethylol propane, adipic acid, and isophthalic acid.

12. The method according to clam 10, wherein said curing agent is an imino melamine.

13. The method according to claim 1, wherein said solventborne primer coating composition comprises a polyester having reactive functional groups and a curing agent reactive with said reactive functional groups of said polyester.

14. The method according to claim 13, wherein said polyester is a reaction product of neopentyl glycol, neopentyl glycol hydroxy pivalate, trimethylol propane, adipic acid, e-caprolactone, and isophthalic acid.

15. The method according to claim 13, wherein said curing agent is melamine.

16. The method according to claim 1, wherein said solventborne primer coating composition further comprises cellulose acetate butyrate.

17. The method according to claim 1, wherein said solventborne primer coating composition comprises a fast solvent.

18. A method of coating a substrate comprising:

(a) applying a solventborne primer coating composition onto at least a portion of said substrate;

(b) applying a solventborne color containing coating composition onto at least a portion of said solventborne primer coating composition, wherein said solventborne color containing coating composition comprises a colorant and an insoluble microparticle;

(c) applying a substantially non-pigmented coating composition onto at least a portion of said solventborne color containing coating composition; and (d) curing at least a portion of said solventborne primer coating composition, said solventborne color containing coating composition, and said substantially non-pigmented coating composition;

wherein said solventborne primer composition and/or said solventborne color containing coating composition further comprises cellulose acetate butyrate.

19. A method of coating a substrate comprising:

(a) applying a solventborne primer coating composition onto at least a portion of said substrate, wherein said solventborne primer coating composition comprises cellulose acetate butyrate;

(b) applying a solventborne color containing coating composition onto at least a portion of said solventborne primer coating composition, wherein said solventborne color containing coating composition comprises a colorant and an insoluble microparticle; and (c) curing at least a portion of said solventborne primer coating composition and said solventborne color containing coating composition.

* * * * *